US005651705A

United States Patent [19]

Hsu

[11] Patent Number: 5,651,705

[45] Date of Patent: Jul. 29, 1997

[54] CONTACT TERMINAL OF A MEMORY CARD PLUG CONNECTOR

[76] Inventor: Fu-Yu Hsu, No. 1-2, Lane 975, Chun-Jih Road, Tao-Yuan City, Taiwan

[21] Appl. No.: 549,186

[22] Filed: Oct. 27, 1995

[51] Int. Cl.[6] ..... H01R 11/22

[52] U.S. Cl. ..... 439/852; 439/856

[58] Field of Search ..... 439/842, 843, 439/851–856, 861, 862

[56] References Cited

U.S. PATENT DOCUMENTS 4,874,338 10/1989 Bakermans ..... 439/851
5,326,288 7/1994 Lu et al. ..... 439/851

*Primary Examiner*—David L. Pirlot
*Attorney, Agent, or Firm*—Morton J. Rosenberg; David I. Klein

[57] ABSTRACT

A contact terminal having two locating portions at two opposite ends for receiving a contact pin, a curved mounting tail longitudinally backwardly extended from one locating portion for fastening to the memory card, an upper connecting portion and a lower connecting portion connected between the locating portions at different elevations, the upper connecting portion and the lower connecting portion having a respective contact portion curved inwards in the middle toward each other for holding down the contact pin, and a longitudinal clamping strip suspended from one locating portion, the longitudinal clamping strip having one end extended from one locating portion toward the other locating portion, an opposite end suspending between the upper connecting portion and the lower connecting portion, and a contact portion curved inwards in the middle toward the contact portions of the upper connecting portion and the lower connecting portion for contact with the contact pin.

1 Claim, 6 Drawing Sheets

CONTACT TERMINAL OF A MEMORY CARD PLUG CONNECTOR

BACKGROUND OF THE INVENTION

The present invention relates to memory cards, and relates more particularly to a contact terminal for memory card plug connectors which prevents contact errors.

Various memory cards have been developed for connection to a card jack on a computer system for storing data. As illustrated in FIG. 1, the card jack, referenced by 1, comprises an insertion slot 11 at the front side, and a set of contact pins 12 for connection to the circuit board of the computer system. The memory card, referenced by 3, has a plug connector 4 for insertion into the insertion slot 11, and a set of contact terminals 41 mounted in the plug connector 4 for connection to the contact pins 12 respectively. As illustrated in FIGS. 2 and 3, each of the contact terminals 41 comprises a curved upper clamping section 411 and a curved lower clamping section 412 for contacting one contact pin 12. Because the contact pin 12 is disposed in contact with the upper clamping section 411 and the lower clamping section 412 at a respective contact point, the contact pin 12 tends to displace, causing a contact error. FIGS. 4 and 5 shows another structure of contact terminal for this purpose. This contact terminal, referenced by 42, comprises two substantially C-shaped clamping portions 420 at two opposite ends, and three longitudinal connecting portions 421, 422, and 423 connected between the C-shaped clamping portions 420. However, this structure of contact terminal is still not satisfactory in function. During the installation of the memory card, much effort must be given to the plug connector of the memory card against the card jack so that the contact terminals 42 of the plug connector of the memory card can be respectively forced into engagement with the contact pins 12 of the card jack. However, when the contact terminals 42 are forced into engagement with the contact pins 12 of the card jack, the contact pins 12 tend to be deformed or broken. Another drawback of this structure of contact terminal is that frequently mounting and dismounting the contact terminal will cause the longitudinal connecting portions to lose their elastic resilient material property. If the longitudinal connecting portions lose their elastic resilient material property, a positive contact between the contact terminal and the respective contact pin cannot be obtained.

SUMMARY OF THE INVENTION

The present invention has been accomplished to provide a contact terminal for the plug connector of a memory card which eliminates the aforesaid drawbacks. It is one object of the present invention to provide a contact terminal which ensures a positive contact when connected to the corresponding contact pin of the card jack. It is another object of the present invention to provide a contact terminal which does not damage the corresponding contact pin when connected to the card jack. It is still another object of the present invention to provide a contact terminal which is durable in use. According to the preferred embodiment of the present invention, the contact terminal comprises two locating portions at two opposite ends for receiving a contact pin, a curved mounting tail longitudinally backwardly extended from one locating portion for fastening to the memory card, an upper connecting portion and a lower connecting portion connected between the locating portions at different elevations, the upper connecting portion and the lower connecting portion having a respective contact portion curved inwards in the middle toward each other for holding down the contact pin, and a longitudinal clamping strip suspended from one locating portion, the longitudinal clamping strip having one end extended from one locating portion toward the other locating portion, an opposite end suspending between the upper connecting portion and the lower connecting portion, and a contact portion curved inwards in the middle toward the contact portions of the upper connecting portion and the lower connecting portion for contact with the contact pin.

BRIEF DESCRIPTION OF THE DRAWINGS

FIG. 11 shows the position of the plug connector on the memory card relative to the card jack according to the present invention.

DETAILED DESCRIPTION OF THE PREFERRED EMBODIMENT

Figure 1:
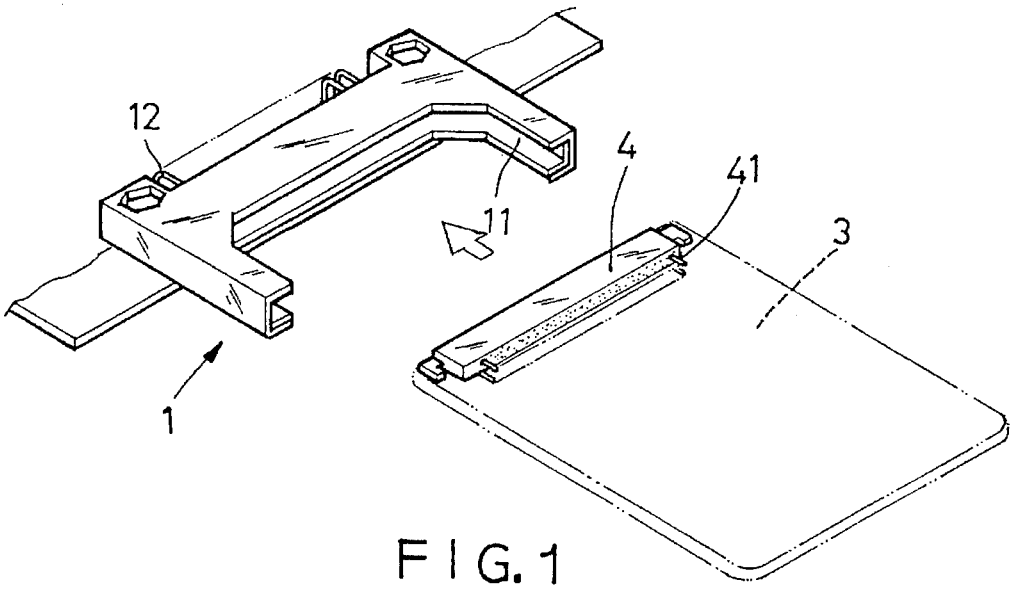
FIG. 1 (PRIOR ART)
FIG. 1 shows the relative relation between a card jack and the plug connector of a memory card according to the prior art.
Figure 2:
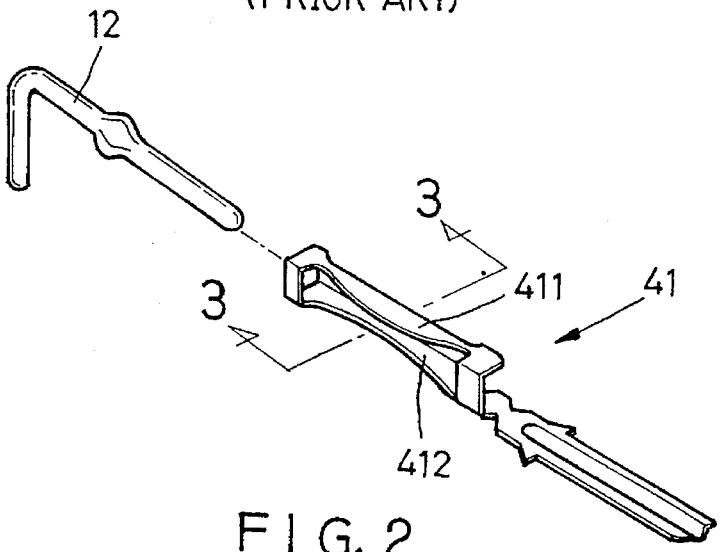
FIG. 2 (PRIOR ART)
FIG. 2 shows one contact pin of the card jack of FIG. 1 and on contact terminal of the plug connector of the memory card thereof.
Figure 3:
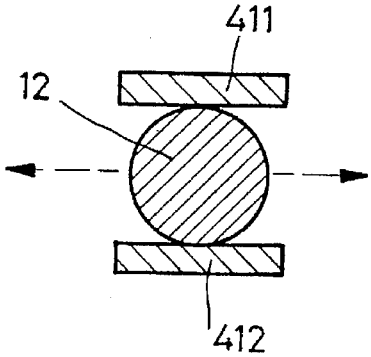
FIG. 3 (PRIOR ART)
FIG. 3 is a cross sectional view taken along line 3—3 of FIG. 2.
Figure 4:
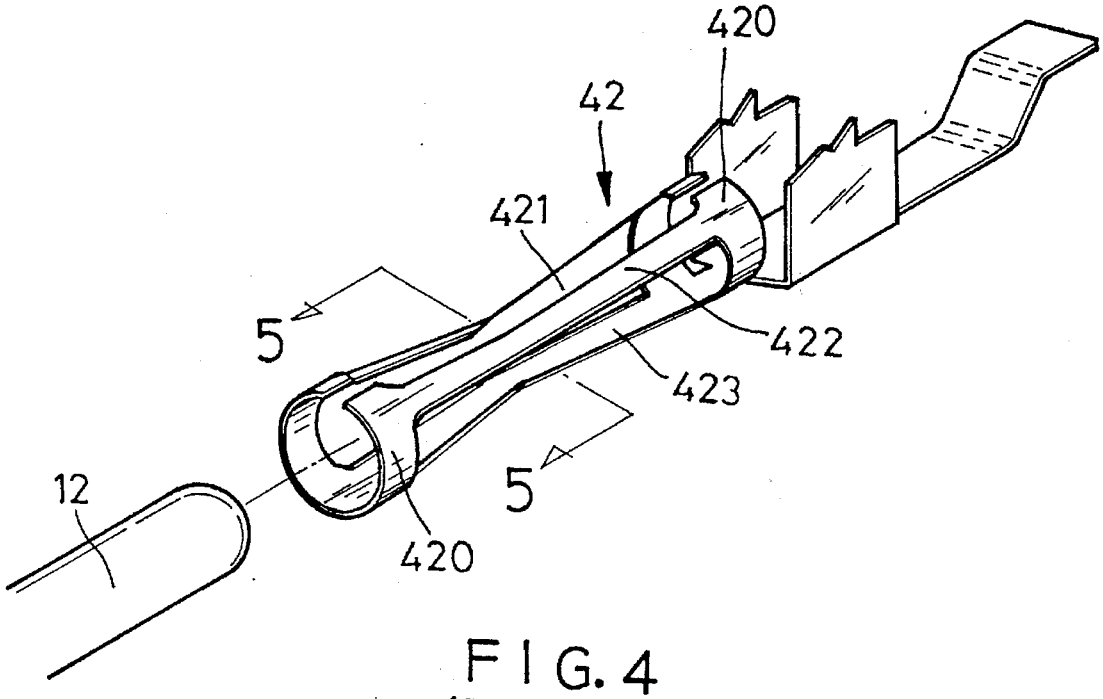
FIG. 4 (PRIOR ART)
FIG. 4 shows another structure of contact terminal according to the prior art.
Figure 5:
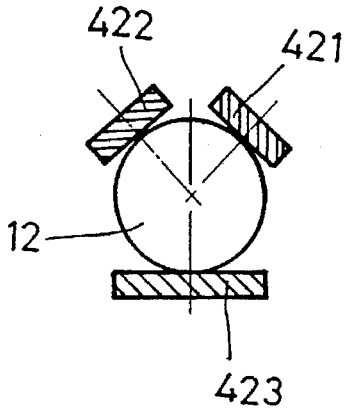
FIG. 5 (PRIOR ART)
FIG. 5 is a cross sectional view taken along line 5—5 of FIG. 4.
Figure 6:
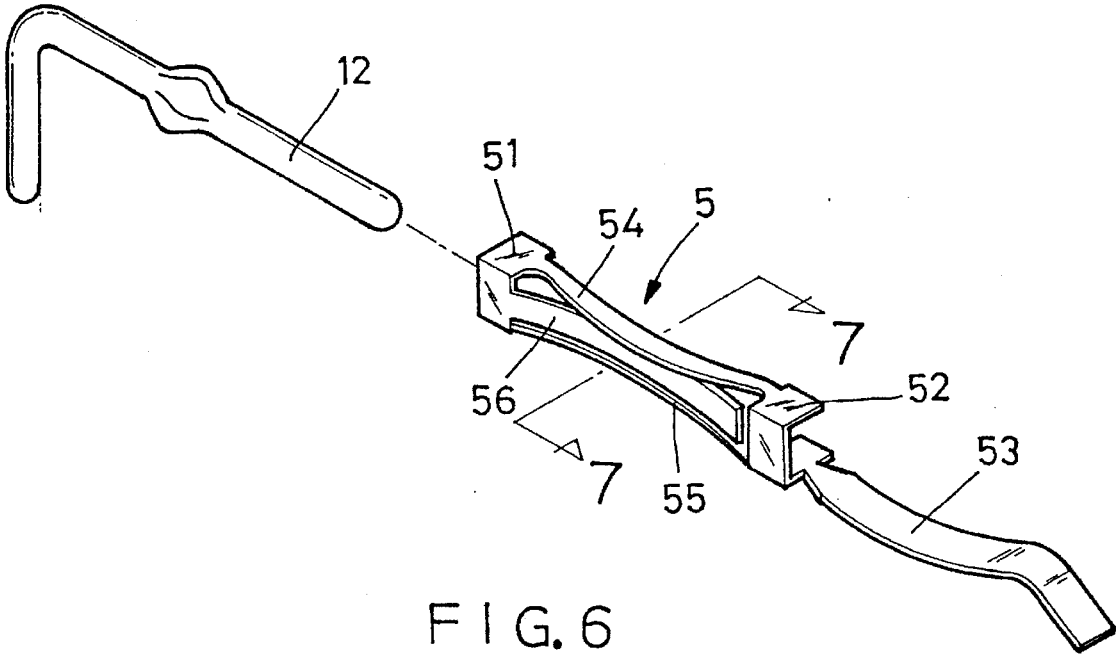
FIG. 6 is an elevational view of a contact terminal according to the present invention.
Figure 7:
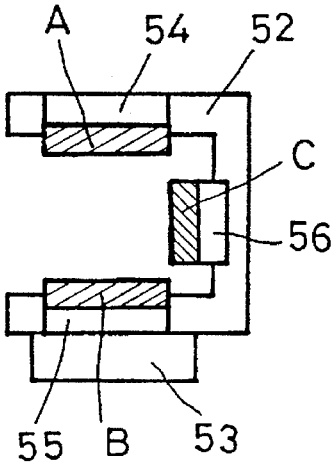
FIG. 7 is a cross sectional view taken along line 7—7 of FIG. 6.

Referring to FIGS. 6 and 7, the contact terminal, referenced by 5, comprises front locating portion 51 and a rear locating portion 52 at two opposite ends, a curved mounting tail 53 longitudinally backwardly extended from the rear locating portion 52 reversed to the front locating portion 51, an upper connecting portion 54 and a lower connecting portion 55 connected between the front locating portion 51 and the rear locating portion 52 at different elevations, and a longitudinal clamping strip 56 extended from the front locating portion 51 toward the rear locating portion 52. The upper connecting portion 54 has a contact portion A curved inwards in the middle toward the longitudinal central axis of the contact terminal 5. The lower connecting portion 55 has a contact portion B curved inwards in the middle toward the longitudinal central axis of the contact terminal 5 (i.e., toward the contact portion A of the upper connecting portion 54). The longitudinal clamping strip 56 has one end fixedly connected to the front locating portion 51, an opposite end suspending in the space between the upper connecting portion 54 and the lower connecting portion 55 adjacent to the rear locating portion 52, and a contact portion C curved inwards in the middle toward the longitudinal central axis of the contact terminal 5.

Figure 8:
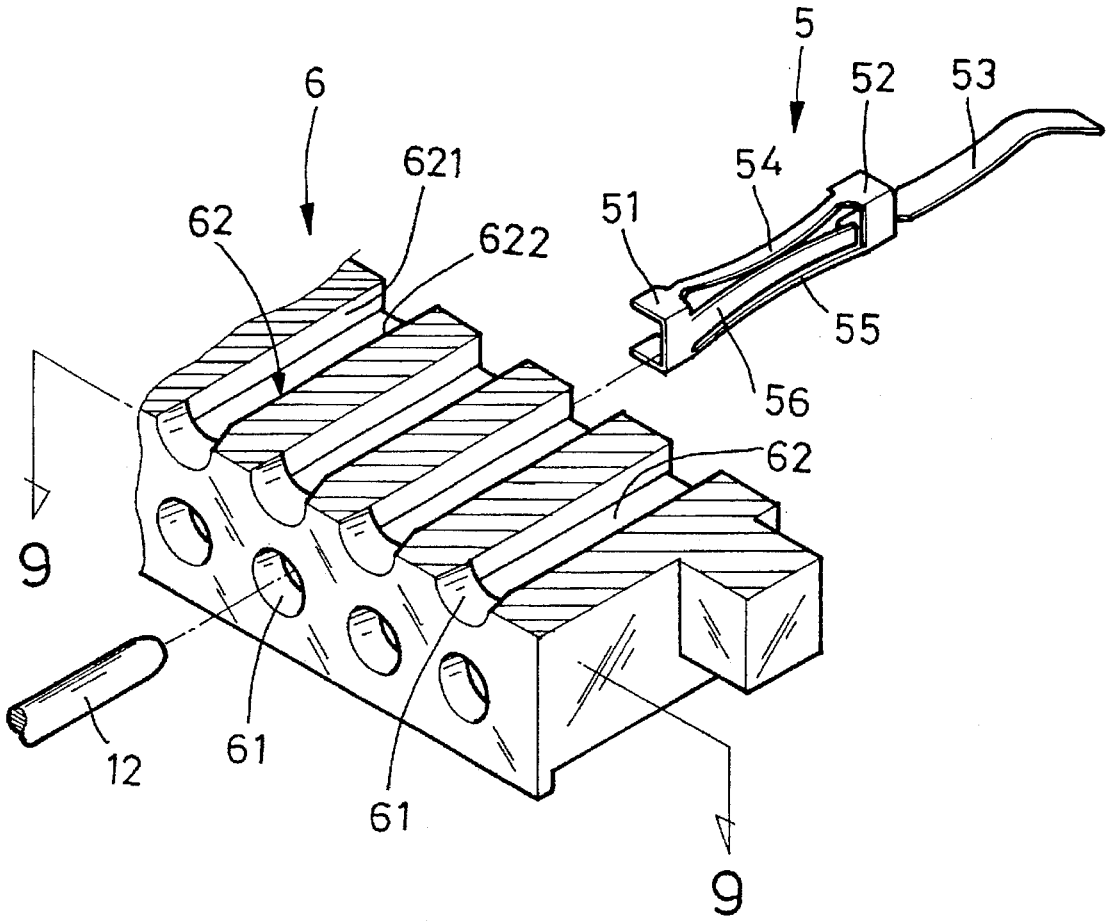
FIG. 8 is a cutaway of the plug connector of a memory card, showing the positioning of one contact terminal in one terminal slot according to the present invention.

Referring to FIG. 8, the plug connector, referenced by 6, has rows of square terminal slots 61 for mounting a respective contact terminal 5. Each of the square terminal slots 61 has a horn-like front orifice 61 convenient for the insertion of one contact pin 12 into engagement with the corresponding contact terminal 5.

Figure 9:
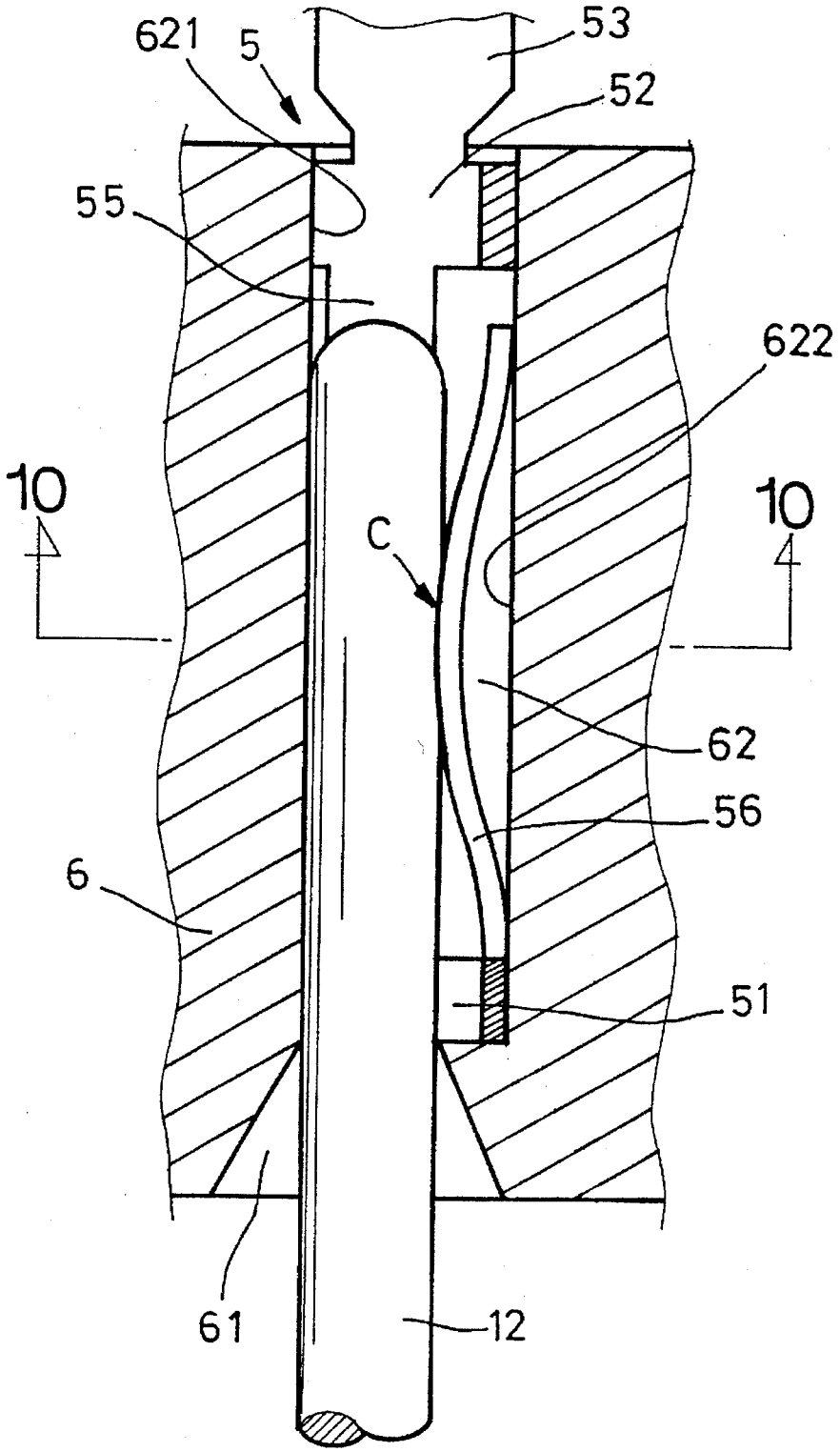
FIG. 9 is a sectional view taken along line 9—9 of FIG. 8.
Figure 10:
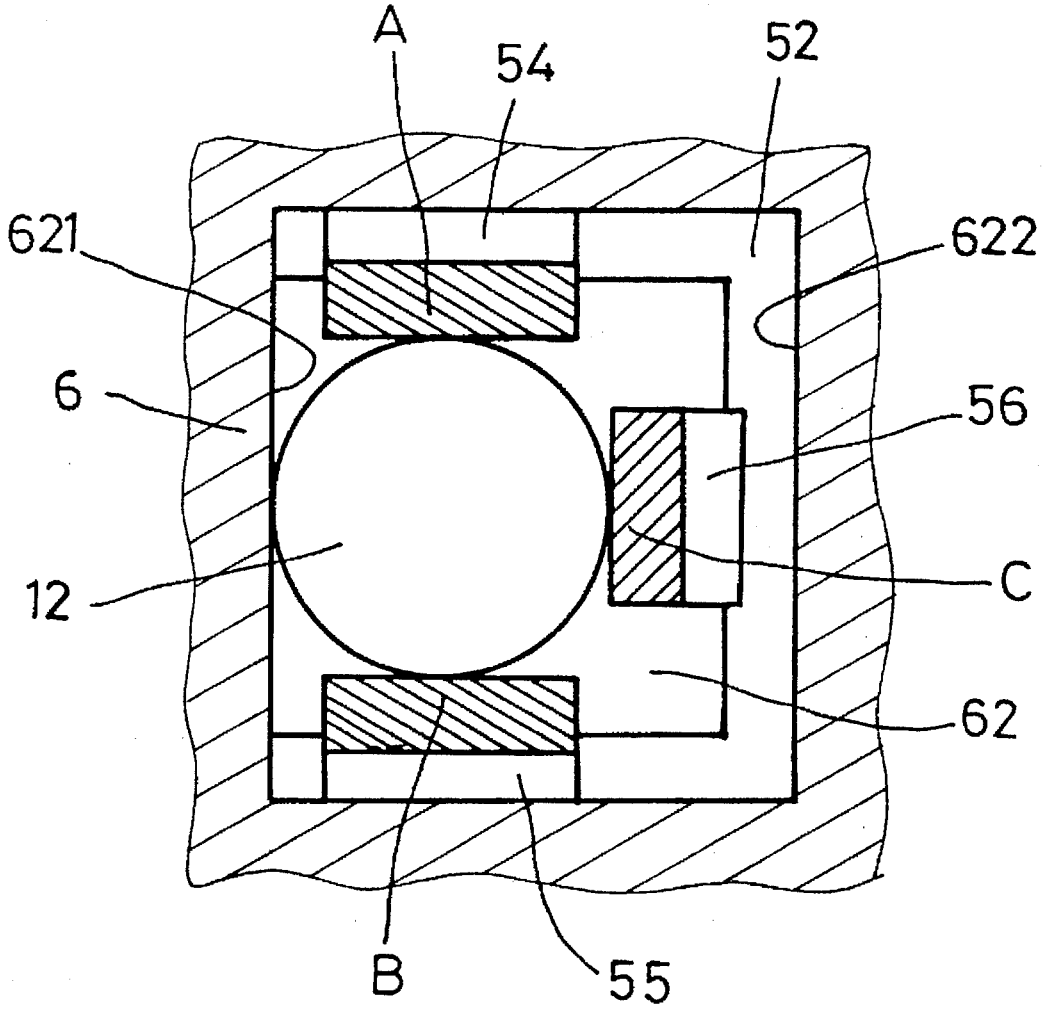
FIG. 10 is a sectional view taken along line 10—10 of FIG. 9.

Referring to FIGS. 9 and 10, when the contact pin 12 is inserted through the horn-like orifice 61 of one square terminal slot 62 into engagement with the corresponding contact terminal 5, the contact pin 12 is retained in contact with the contact portions A, B, and C, the longitudinal clamping strip 56 is stopped at one vertical side wall 622 of the respective square terminal slot 62 to force the contact pin 12 against an opposite vertical side wall 621 of the respective square terminal slot 62, therefore the contact pin 12 is firmly retained in place between the contact portions A, B, and C, and the vertical side wall 621 of the respective square terminal slot 62.

Furthermore, as an alternate form of the present invention, the longitudinal clamping strip 56 made having one end fixedly connected to the rear locating portion 52 and an opposite end suspending in the space between the upper connecting portion 54 and the lower connecting portion 55 adjacent to the front locating portion 51.

Referring to FIG. 11, the mounting tails 53 of the contact terminals 5 are respectively extended out of the back side of the plug connector 6 for fastening to the memory card 4; the plug connector 6 can be inserted into the insertion slot 11 of the card jack 1 to connect the contact terminals 5 to the contact pins 12.

As indicated, the present invention provides a contact terminal which permits the contact pin to be firmly supported at four sides and retained in positive contact upon its insertion into the respective terminal slot on the plug connector of the memory card.

It is to be understood that the drawings are designed for purposes of illustration only, and are not intended as a definition of the limits and scope of the invention disclosed.

I claim:

1. A contact terminal installed within one terminal slot of a plug connector of a memory card for connection to a respective contact pin in a card jack, the contact terminal comprising:

a pair of locating portions disposed on opposing front and rear ends of said contact terminal;

a curved mounting tail extending longitudinally from said rear end of said contact terminal for coupling to the memory card;

an upper connecting portion extending longitudinally between said front and rear ends of said contact terminal;

a lower connecting portion extending longitudinally between said front and rear ends of said contact terminal and disposed in vertically spaced relationship with said upper connecting portion, each of said upper and lower connecting portions having a respective contact portion curved inwardly toward each other; and, a longitudinally extended clamping strip cantilevered from one of said pair of locating portions and positioned vertically between said upper and lower connecting portions, said clamping strip having a centrally disposed inwardly curved portion for firmly positioning the contact pin in contact with said contact portions of said upper and lower connecting portions.

* * * * *